US005644910A

United States Patent [19]

Ball et al.

[11] Patent Number: 5,644,910

[45] Date of Patent: Jul. 8, 1997

[54] OPEN-END SPINNING ROTOR WITH SMOOTH NON-IMPACTED SURFACES

[75] Inventors: Anthony A. Ball, Charleston, S.C.; Heinz Müller, Metzingen; Wolfgang Thierron, Kösching, both of Germany

[73] Assignee: Rieter Ingolstadt Spinnereimaschinenbau AG, Ingolstadt, Germany

[21] Appl. No.: 340,276

[22] Filed: Nov. 15, 1994

[30] Foreign Application Priority Data

Dec. 23, 1993 [DE] Germany ..... 43 44 012.6

[51] Int. Cl.[6] ..... D01H 4/00

[52] U.S. Cl. ..... 57/416; 57/414; 57/415; 57/417

[58] Field of Search ..... 57/414, 415, 416, 57/417

[56] References Cited

U.S. PATENT DOCUMENTS

| | | | |
|---|---|---|---|
| 3,903,683 | 9/1975 | Shino | 57/417 |
| 4,193,253 | 3/1980 | Herbert et al. | 57/414 |
| 4,397,144 | 8/1983 | Raasch et al. | 57/416 |
| 4,492,077 | 1/1985 | Raasch et al. | 57/414 |
| 4,663,929 | 5/1987 | Raasch et al. | 57/416 |
| 4,663,930 | 5/1987 | Landwehrkamp | 57/416 |
| 4,866,927 | 9/1989 | Fetzer et al. | 57/416 |

FOREIGN PATENT DOCUMENTS

| | | | |
|---|---|---|---|
| 1710003 | 5/1972 | Germany . | |
| 40-4343722 | 11/1992 | Japan | 57/416 |

*Primary Examiner*—William Stryjewski
*Attorney, Agent, or Firm*—Dority & Manning

[57] ABSTRACT

A spinning rotor for an open-end spinning device is proposed which is provided with a smooth surface at the critical locations in order to avoid deposits within the spinning rotor at its inner surface. The ring-shaped zone of the inner surface of the spinning rotor near its edge as well as the area of its bottom may for instance be made especially smooth by polishing.

7 Claims, 1 Drawing Sheet

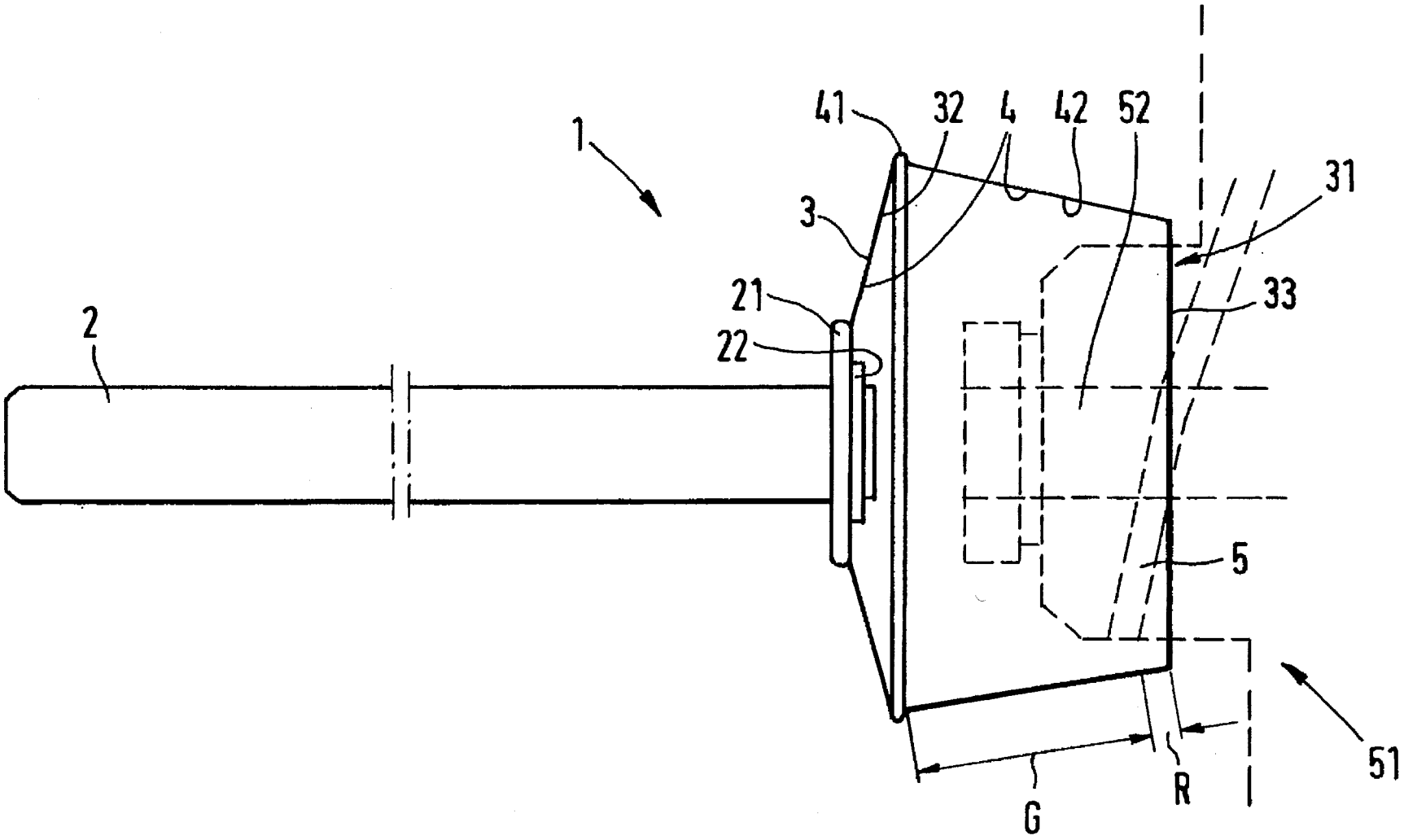
51
31
33
5
R
52
42
4
32
41
3
21
22
G
1
2

OPEN-END SPINNING ROTOR WITH SMOOTH NON-IMPACTED SURFACES

BACKGROUND OF THE INVENTION

The present invention relates to a spinning rotor for an open-end spinning device. Such a spinning rotor is known from DE-AS 17 10 003, for instance. The spinning rotor shown therein is equipped with a spinning turbine wall which has a fiber gliding surface on which the fibers brought into the spinning rotor are fed so that the rotational movement of the spinning rotor causes them to glide along the fiber sliding surface into the fiber collection groove of the spinning rotor. The fiber gliding surface of the spinning rotor shown in the DE-AS 17 10 003 is subdivided into different zones which are provided with different frictional coefficients. This is achieved through different angles of inclination of the fiber gliding surface or also through differences in roughness of this surface. As the fibers are fed into the rotor plate they are brought by a feeding device on the fiber gliding surface of the spinning rotor. This point is at a distance of approximately 1–5 mm from the edge of the open side of the spinning rotor in order to avoid overfeeding of the fibers which would then be lost to the spinning process. From the impact point of the fibers they glide over the fiber gliding surface into the fiber collection groove from which they are drawn off again in a known manner to form a yarn.

The known spinning rotors have the disadvantage that deposits form within the rotor plate of the spinning rotor and collect at points which are not fed any fibers. Thus, especially when processing chemical fibers and mixtures thereof, admixtures or deposits (so-called avivage) "collects" collect near the bottom and between the edge of the open side of the rotor plate and the zone in wihch the fed fibers glide on the fiber gliding surface. These deposits may lead to interference with the spinning process. Thus for instance, such deposits may burst away during operation so that they come into the zone of the fiber collection groove and may cause a yarn defect or yarn breakage. Deposits near the edge of the open side of the spinning rotor render piecing of the yarn following a yarn breakage more difficult or prevent it. As a result, a greater expenditure for maintenance is required because the deposits are difficult to remove through automatic cleaning devices of the spinning device or because it may be necessary, for example to remove the deposits by hand.

OBJECTS AND SUMMARY OF THE INVENTION

It is a principal object of the instant invention to design an open-end spinning rotor in such a manner that the disadvantages of the state of the art may be avoided and the formation of deposits may be prevented or reduced, and also so that the manual or automatic removal of the deposits may be carried out with greater ease. Additional objects and advantages of the invention will be set forth in part in the following description, or will be obvious from the description, or may be learned through practice of the invention.

The design of the spinning rotor according to the invention makes it possible for the deposits to collect less easily at the surface of the spinning rotor. Thanks to the smooth surface which has a minimal roughness depth and good gliding characteristics, dirt particles tending to collect cannot be deposited as easily on or in the surface. They are instead removed from the rotor plate, e.g. by the flowing air, or they reach the fiber collection groove from which they are removed again by the produced yarn and are removed out of the rotor plate. An additional advantage consists in the fact that deposits which may nevertheless have formed are removed much more easily from the sides of the spinning rotor by the automatic cleaning device of the spinning device or manually.

The smooth surface is advantageously achieved in that the appropriate areas of the inner surface of the rotor plate are provided with a coating. Such a coating may be a metal coating for example, which may be deposited in a chemical or electrolytic process. It is especially advantageous for the smooth surface to be formed by mechanical machining, e.g. polishing. It is especially advantageous if the coating is subsequently subjected to additional polishing. In an advantageous embodiment of the invention, the inner surface of the rotor plate is polished in the area between the fiber gliding surface and the edge of the rotor plate. This is especially advantageous because deposits in this area of the spinning rotor especially produce disturbances during the piecing of the rotor. It is especially advantageous if the area of fiber impact on the rotor side is polished overlappingly, since no fibers are fed to this area or are fed only partially and very irregularly. In a particularly advantageous embodiment of the invention, the area going from the edge towards the fiber collection groove and measuring from 1 mm to 5 mm is polished and/or coated. This makes it possible to design the spinning rotor with a sufficiently large safety zone against overfeeding of fibers. In another especially advantageous embodiment, the bottom area of the rotor plate is polished and/or coated so that the formation of deposits in this area is prevented. It is especially advantageous for the surface to be made so smooth that it has a roughness with a value $R_z$ of less than ⅔ the roughness of the fiber gliding surface. In making the smooth surface with a roughness $R_z$ of less than 1.2 μm, a surface that is inexpensive to produce is achieved, having sufficient smoothness to prevent the formation of deposits. It is especially advantageous for the smoothness to have a value of between $R_z$=0.1 and $R_z$=1. Thanks to the especially good surface quality, the deposit of avivage is prevented or is very much retarded, so that the operating time of the spinning rotor until its cleaning is especially long.

BRIEF DESCRIPTION OF THE DRAWINGS

FIG. 1 is a detailed component view of a spinning device according to the invention.

DETAILED DESCRIPTION OF THE PREFERRED EMBODIMENTS

Reference will now be made in detail to the presently preferred embodiments of the invention, an example of which is illustrated in the accompanying drawing. The example is provided by way of explanation of the invention, and not as a limitation of the invention.

FIG. 1 shows a spinning rotor 1 for an open-end spinning device. The spinning rotor 1 has a shaft 2 and a rotor plate 3. The rotor plate 3 and the shaft 2 are connected to each other in a known manner by means of a disk spring 22 which bears upon a hub 21 of shaft 2. The rotor plate 3 is made in the form of a thin-walled metal sheet rotor, but the present invention is also applicable to thick-walled steel or aluminum rotors. The rotor plate 3 is cup-shaped and closed at its bottom and is connected to the shaft 2. The type of connection shown is given as an example. The instant invention is of course also useable with rotors which have a hub formed on the bottom of the shaft or which are connected in some other manner to the shaft. The rotor plate 3 has an open side 31 across from the bottom 32 which is delimited by edge 33. On the inside the rotor plate 3 has an inner surface 4 the configuration of which is the basis for the invention.

The known rotors, as with the one shown here, possess as their inner surfaces essentially a fiber collection groove 41 into which the fibers gliding along the fiber gliding surface 42 enter and from which they are removed again in a known manner in the form of a yarn. The surface of the bottom of the shown spinning rotor follows the fiber collection groove 41 and constitutes the closed side of the rotor plate 3. In the present FIG. 1, a feeding device 51 is shown in broken lines and serves to convey the separated fibers into the spinning rotor. They travel through the fiber feeding channel 5 with an air stream to the fiber gliding surface 42 upon which they are pressed by the centrifugal force of the rotating spinning rotor 1 and glide, due to the inclination of the fiber gliding surface 42, under the impetus of the centrifugal force into the fiber collection groove 41. Especially when chemical fibers or mixtures thereof are processed, dust-like particles travel together with the fibers and the air stream through the fiber feeding channel 5 and into the rotor plate 3. These particles are basically admixtures which improve the process of chemical fiber spinning but which may produce problems when the fibers are spun in the spinning rotor of an open-end spinning device. As long as these admixtures adhere to the fibers or enter the fiber collection groove together with the fibers without settling there, no interference of the spinning process occurs.

However, if these admixtures are not removed from the rotor they form so-called avivage there, which may interfere with the spinning process. The deposits interfering with the spinning process form mostly on parts of the inner wall of the rotor plate which are not impacted by fibers. These surfaces are the bottom 32 of the rotor plate 3 as well as a narrow ring at the open side of the rotor plate, starting at the edge 33 and going in the direction of the fiber collection groove 41. This area is not impacted by the fibers fed by means of the fiber feeding channel 5 and constitute a safety zone, so that no fibers being fed may be removed over the edge of the rotor plate. This ring-shaped zone R of the rotor plate 3 is therefore most easily soiled by deposits of avivage. The zone G of the fiber gliding surface following the zone R in the direction of the fiber collection groove 41, on the other hand, is kept clean by the fibers gliding into the fiber collection groove 41 during the spinning process. No deposits can be produced since the fibers gliding over the surface prevent the formation of deposits. The passage between the zone G and the zone R may be a flowing one, since the feeding of fibers on the inner wall of the rotor plates does not allow for any clear delimitation. For this reason it may be advantageous to make the ring-shaped zone R somewhat larger as a precaution. Many embodiments of spinning rotors are provided with a coating on their inner surface which is coated for the purpose of wear protection or in order to achieve favorable spinning conditions. This coating results at times in particular roughness of the surface of the inside of the rotor plate. But also in lathed rotors or those made of sheet metal the inner surface of the rotor plate has a roughness which may be advantageous for the spinning process but is particularly receptive to settling deposits of avivage. The roughness on the inner surfaces of known spinning rotors is approximately $R_z$=1.5 for coated spinning rotors and of approximately $R_z$=3 for spinning rotors made of sheet metal.

The spinning rotor 1 shown here is designed according to the invention in such a manner that the inner surface of the rotor plate 3 is smoothed by means of a polished surface in the ring-shaped zone R. In this case a flowing passage from the ring-shaped zone R into the zone G of the fiber gliding surface 42 is also possible. In case that deposits collect in the area of the fiber gliding surface where the fibers are being fed, it is advantageous to polish this area too. Thanks to the polished surface with a roughness between $R_z$=1.2 and $R_z$=0.7, and to particular advantage a roughness of $R_z$=1 to $R_z$=0.1, much less avivage can be deposited. In addition this provides the advantage that avivage which may be deposited can be removed more easily by automatic maintenance devices or by hand because their adhesive strength is significantly diminished. In another not shown embodiment of a spinning rotor according to the invention, the smooth surface is obtained by a coating which may furthermore be polished according to the invention if necessary. A very hard surface for example, is pre-smoothed by a suitable coating and can then be polished thoroughly. Nickel or some other metal with a smooth structure is well-suited for such a coating.

The inner surface of the rotor plate 3 near the bottom 32 is polished according to the invention in this spinning rotor. This polished surface, just as the surface of the ring-shaped zone R, is therefore less prone to deposits of avivage on this inner surface of the rotor plate 3. This zone also has the advantage that if deposits have occurred, they adhere less and can therefore be removed more easily. The roughness values in the area of the inner surface of the bottom 32 of the rotor plate are of the same order of magnitude as in the ring-shaped zone R.

The extension of the ring-shaped zone R from the edge 32 of the rotor plate 3 towards the fiber collection groove 41 measures advantageously approximately 3 mm in the present embodiment. However these values can be greater or smaller, depending on the size of the rotor and the desired safety distance between feeding zone and rotor edge. It is thus possible for a rotor with a fiber collection groove diameter of 30 mm to have an extension of 0.8 to 2.0 mm of the ring-shaped zone R, while a spinning rotor with a diameter of 38 mm may have a value of 3.0 to 6.0 mm in the area of the fiber collection groove.

The manner in which the coating or the polished surfaces are produced is immaterial for the invention, but the degree of roughness of these surface is important. By "polished", a special treated surface with low roughness is meant with respect to the present invention. This can be achieved by polish-grinding, roller-burnishing or lapping. The indicated roughness values $R_z$ indicates the roughness 8 depth in μm, as described for example by DIN 4768. It is not the precise measured definition of the roughness depth but the characteristics resulting from the smoothness of the surface in order to avoid the collection of deposits which are essential for the instant invention.

It will be apparent to those skilled in the art that various modifications and variations can be made in the present invention without departing from the scope and spirit of the invention. For example, features illustrated or described as part of one embodiment can be used on another embodiment to yield a still further embodiment. It is intended that the present invention cover such modifications and variations as come within the scope of the appended claims and their equivalents.

We claim:

1. A spinning rotor for an open-end spinning device, said spinning rotor comprising:

a shaft;

a rotor plate configured at an end of said shaft, said rotor plate comprising a bottom, a fiber collection groove, and an open side defined by an edge, said rotor plate further comprising a fiber gliding surface defined therein adjacent said fiber collection groove, said fiber gliding surface being impacted by fibers fed to said spinning rotor; and said rotor plate further comprising non-impacted inner surfaces comprising a smooth ring-shaped zone between said edge and said fiber gliding surface and an area of said rotor plate bottom defined therein which are not impacted by fibers fed to said spinning rotor during yarn spinning operations, said non-impacted inner surfaces having a surface smoothness greater than that of said fiber gliding surface so as to prevent the buildup of, deposits thereon.

2. The spinning rotor as in claim 1, wherein said smooth non-impacted inner surface comprises a coating, said coating having a smoothness so as to prevent deposit buildup thereon.

3. The spinning rotor as in claim 1, wherein said smooth non-impacted inner surface comprises a polished surface, said polished surface having a smoothness so as to prevent deposit buildup thereon.

4. The spinning rotor as in claim 1, wherein said ring-shaped zone is from 1 to 5 mm from said edge towards said fiber collection groove.

5. The spinning rotor as in claim 1, wherein said smooth non-impacted inner surfaces comprise a roughness characteristic less than ⅔ of the roughness of said fiber gliding surface.

6. The spinning rotor as in claim 5, wherein said smooth non-impacted inner surfaces comprise a roughness characteristic of less than $R_z$=1.2.

7. The spinning rotor as in claim 1, wherein said smooth non-impacted inner surfaces comprise a roughness characteristic of between $R_z$=0.1 and $R_z$=1.0.

* * * * *